US005598174A

United States Patent [19]

Erkocevic et al.

[11] Patent Number: 5,598,174

[45] Date of Patent: Jan. 28, 1997

[54] PRINTED SLEEVE ANTENNA

[75] Inventors: Nedim Erkocevic, Nieuwegein; Augustinus M. Jansen, St. Michielsgestel, both of Netherlands

[73] Assignee: Lucent Technologies, Inc., Murray Hill, N.J.

[21] Appl. No.: 538,316

[22] Filed: Oct. 3, 1995

[30] Foreign Application Priority Data

Aug. 12, 1995 [GB] United Kingdom ..... 9516564

[51] Int. Cl.[6] ..... H01Q 9/28

[52] U.S. Cl. ..... 343/795; 343/702; 343/821

[58] Field of Search ..... 343/700 MS File, 343/702, 725, 792, 793, 795, 798, 801, 803, 821, 853; H01Q 9/28

[56] References Cited

U.S. PATENT DOCUMENTS 4,015,265 3/1977 Dubost et al. ..... 343/803

5,182,570 1/1993 Nysen et al. ..... 343/795

5,440,317 5/1993 Jalloul ..... 343/791

5,495,260 2/1996 Conture ..... 343/795

*Primary Examiner*—Donald T. Hajeo

*Assistant Examiner*—Tan Ho

*Attorney, Agent, or Firm*—Jason P. DeMont

[57] ABSTRACT

An end fed dipole antenna system comprises first and second quarter wavelength (L/4) conductive strips (12, 14) arranged end-to-end on one side of a PCB (16), and third and fourth conductive L/4 strips (22, 24) on the opposite side of the PCB; the third strip (22) overlying the first strip (12) and the fourth strip (24) having a longer arm lying parallel to the third strip (22). An RF generator (18) of wavelength L is connected to the corresponding outer ends of the overlying strips. Strip parts (14, 24) which do not overlie form an end fed dipole which operates as if it were center fed.

6 Claims, 3 Drawing Sheets

PRINTED SLEEVE ANTENNA

FIELD OF THE INVENTION

This invention relates to an antenna which is compact in design, and which incorporates a balun.

BACKGROUND OF THE INVENTION

The use of a balun has been common for many years, and different designs are well known. It will be appreciated that a balun is a device which is used to couple a balanced impedance, such as an antenna, to an unbalanced transmission line, such as a coaxial cable. A balun prevents asymmetrical loading of the balanced impedance and the induction of currents on the exterior of the unbalanced transmission line.

In European Patent Application No. 0,474,490, there is disclosed an antenna arrangement which may be switched between dipole and monopole modes, the dipole and balun being provided as conducting areas on opposite sides of a printed circuit board, but the arrangement is far from compact, and the dipole lengths are provided by interconnected complex shapes.

SUMMARY OF THE INVENTION

Embodiments of the present invention provide an antenna with balun which is compact in construction and simple to implement in a cost effective manner. According to one embodiment, there is provided an end fed dipole antenna system for a radio frequency generator having an operating wavelength (L), characterized by comprising: on one side of an insulating sheet a first and a second quarter wavelength (L/4) conductive strip in end-to-end connection; on the opposite side of the insulating sheet a third conductive quarter wavelength (L/4) conductive strip, overlying the first conductive strip, and a fourth conductive strip of quarter wavelength (L/4) total length and having a longer arm spaced from and parallel to the third strip and a shorter arm connected to the third strip; and means to connect said radio frequency generator between the end of the third strip remote from the connection to the fourth strip, and the corresponding end of the first strip, whereby the second and fourth strips form a linear dipole antenna.

It is an advantage of an antenna system according to the invention that the provision of a ground plane is unnecessary. This results from the incorporation of the functionality of the balun in the antenna system. Another advantage is that the antenna system can be directly connected to an unbalanced feed means such as a coaxial cable feed line.

In one application there is further provided a second, identical antenna system having its dipole antenna arranged orthogonally to the dipole antenna of the first system. Preferably there is also provided switching means to switch between the two antenna systems in accordance with the strength of the signals received.

In another application, a plurality of identical antenna systems according to the invention may be arranged with all of the dipoles arranged to be parallel, and having a phase shift means between each pair of systems; a steerable antenna array is thereby provided.

In yet another application, a single antenna system may be connected to a hand held wireless terminal.

BRIEF DESCRIPTION OF THE DRAWINGS

The invention will now be described by way of example only with reference to the accompanying drawings in which.

DETAILED DESCRIPTION

Figure 1:
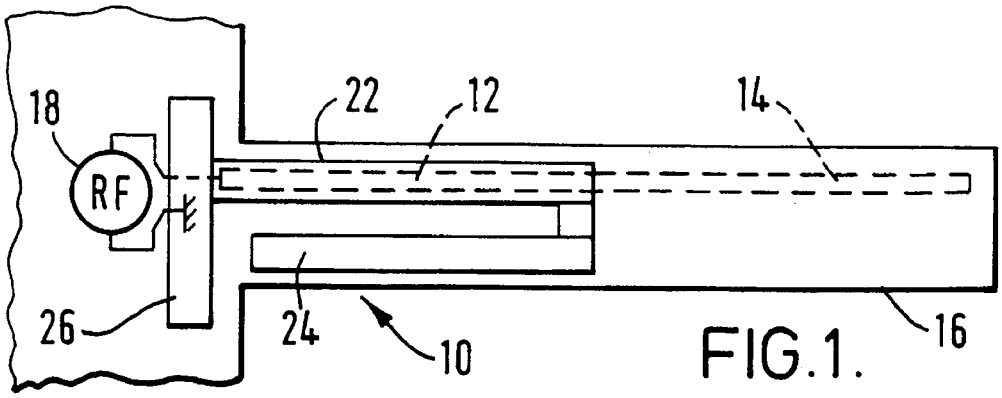
FIG. 1 is a plan view of an antenna system.

Referring now to the drawings, in which like reference numerals identify similar or identical elements, FIG. 1 illustrates an antenna system, indicated generally as 10, which comprises first and second conductive strips 12, 14 on a printed circuit board (PCB) 16. Strips 12, 14 are on the lower side of the PCB as viewed in FIG. 1, and are therefore shown in dashed outline. Each strip is L/4 in length where L is the wavelength of operation, and strips are connected end-to-end. The end of strip 12 remote from strip 14 is connected to one side of a radio frequency (RF) generator 18 operating at wavelength L.

On the upper side of the PCB 16 are third and fourth conductive strips 22, 24; strip 22 is straight and of length L/4 and one end is connected to the other side of the generator 18. Strip 24 is essentially "L" shaped, the longer arm of the L lying parallel to and spaced from strip part 22, and the shorter arm being connected to the opposite end of strip 22 to the generator connection. Adjacent strips 22, 24 is a fifth conducting strip 26 perpendicular to the other four strips. Strip 26 is of relatively small size and provides a suitable connection for unbalanced feed means such as a coaxial feed cable (not shown) which connects the RF source 18 to the antenna. It will be appreciated that with this arrangement, the provision of a true ground plane, which would need to be of much greater size than strip 26, is unnecessary. Strip 22 overlies strip 12, i.e., strips are in register but are separated by the thickness of PCB 16. PCB 16 advantageously follows the general elongated outline of the strips but is of slightly greater area.

Figure 2:
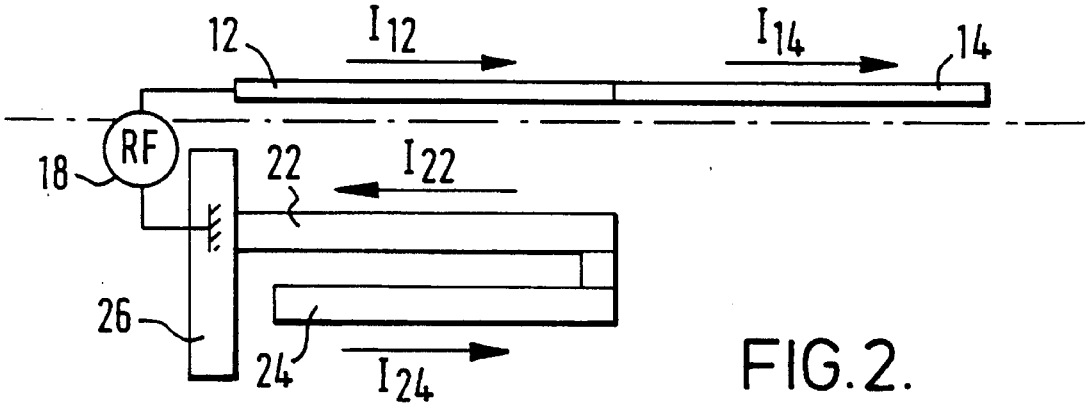
FIG. 2 illustrates schematically the currents in the various parts of the antenna system.

In FIG. 2, both sides of the PCB 16 are shown in a schematic view. Above the chain dashed line are strips 12, 14, and below the chain dashed line are strips 22, 24 and strip 26. While strips 12, 14 are shown to be thinner than strips 22, 24, this is for clarity of illustration only; the strips in practice may be of equal width.

It is well known in antenna theory that for optimum performance the RF currents in each arm of a linear dipole, e.g. that formed by strips 12, 14, must be equal amplitude and phase, that is the dipole must be balanced. This is easily achieved if the dipole is center fed and if it is fed from a balanced source. However, the dipole often has to be connected to an unbalanced source (e.g. coaxial cable or microstrip line) which creates the need for a balun. Moreover the RF signal has to be brought to the center of the dipole (junction between strips 12 and 14) in a way that will not disturb the RF current distribution in the dipole itself.

The placement of strip 22 underneath strip 12 forms a transmission line that will transfer the signal from the RF generator 18 to the junction of strips 12 and 14. Therefore the RF currents $I_{12}$ and $I_{22}$ are of equal amplitude and opposite phase. In such an arrangement, strip 14 attached to strip 12 can be regarded as a L/4 monopole with respect to the virtual ground positioned at the end of strip 22 underneath the junction of strips 12 and 14. We can assume now that the RF generator has moved to the other end of the line formed by strips 12, 22 and has one of its outputs connected to strip 14 and the other floating. In order to ensure that strip operates as a monopole (which is by definition an unbalanced antenna) fed from an unbalanced RF source 18, the effect of a ground plane has to be present and the other (floating) end of the RF generator 18 has to be connected to it. This results in the injecting into this ground plane of an RF current, equal in amplitude and opposite in phase to $I_{14}$.

The effect of the presence of an infinite ground plane (ideal current sink) at this point (end of strip 22 positioned below the junction of strips 12 and 14) is achieved by placing strip 24 parallel to strip 22 and connecting it to strip 22 (at the junction of strips 12 and 14). The L/4 length of strip 24 forms, with respect to strip 22, an open quarter wavelength transmission line and therefore, as seen by monopole 14 (and transferred RF generator 18) appears as an infinitely large ground plane since strip 24 is terminated at a position of zero current and maximum voltage of the standing wave. The result is that the RF currents $I_{24}$ and $I_{14}$ are of equal amplitude and orientation, as in the case of a center fed dipole, while the unbalanced RF generator 18 appears to feed unbalanced monopole antenna 14, through microstrip line 12, 22. The RF currents $I_{12}$ and $I_{22}$ cancel each other in terms of radiation, while currents $I_{14}$ and $I_{24}$ act together as a center fed dipole. More precisely the currents in strips 14 and 24 are distributed in the same way as in the arms of a center fed dipole, creating its effect of a true dipole-like radiation pattern. Although the system operates as if it were center fed, the dipole 14, 24 is in fact end fed (through line 12, 22), and thus has the convenience of an end fed antenna.

If a physical ground plane is provided at the end of strip 22, closer to the actual location of the RF generator 18 (e.g. strip 26) it will be almost free of (unbalanced) ground currents since these are redirected to strip 24, effectively radiating associated energy to the air. This feature of antenna 10 that prevents the occurrence of unbalanced ground currents on the ground plane associated to the antenna feeding point, is important for hand held radio devices since it can lead to significant improvements in RF efficiency.

Figure 3:
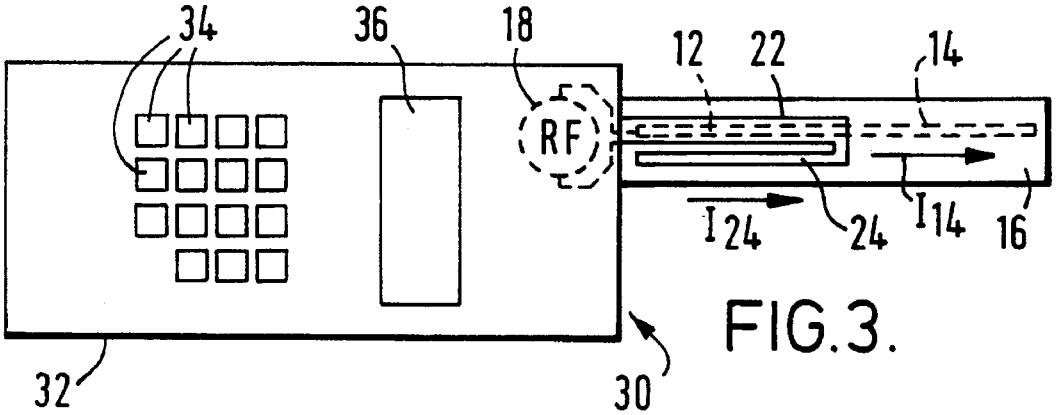
FIG. 3 illustrates an antenna system incorporated in a wireless terminal.

A first example of an application of an antenna system according to the invention is illustrated in FIG. 3, which is a view of a hand held wireless terminal 30 comprising a metalized housing 32 carrying call buttons 34 and a display panel 36. The housing 32 contains the RF generator 18, and from the housing projects a long narrow PCB 16 carrying strips 12, 14 on the reverse side (and therefore shown dashed) and strips 22, 24 on the upper side, strips being connected to opposite sides of the generator 18 as shown in the Fig.

Figure 4:
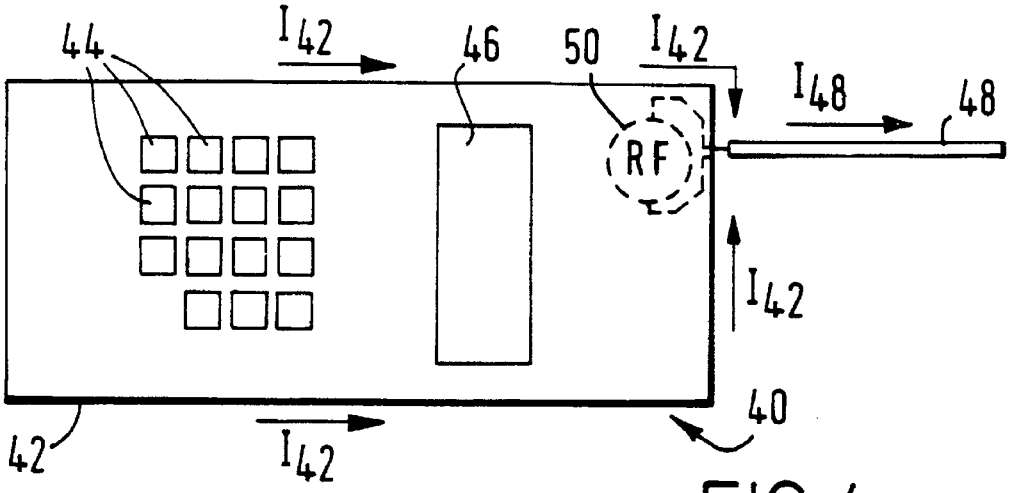
FIG. 4. PRIOR ART
FIG. 4 shows a prior art arrangement.

FIG. 4 shows a prior art hand held wireless terminal 40 comprising a metal casing 42, buttons 44, and display panel 46, and also having a quarter wavelength monopole antenna, or whip antenna, 48. The current $I_{48}$ passing along it is the main source of electromagnetic radiation.

It is well known that a monopole antenna is unbalanced, and therefore the associated RF generator 50 provides only half of its output to the antenna, the other half going to the ground plane, in this arrangement formed by the metalized housing 42. When the user holds the casing, this 50% output is lost, and is represented in FIG. 4 by current $I_{42}$. As the user's hand tissue absorbs the RF power, 50% of the power is lost which is equivalent to 3 dB loss in RF efficiency.

In contrast, in the FIG. 3 arrangement, the use of the inventive antenna system results in the RF currents being confined mainly to the antenna, and the casing 32 is almost free of surface currents. The RF loss by absorption by the user's hand is minimized, giving a performance improvement of up to 3 dB. The convenience of the end-fed format is clear from the figure.

Figure 5:
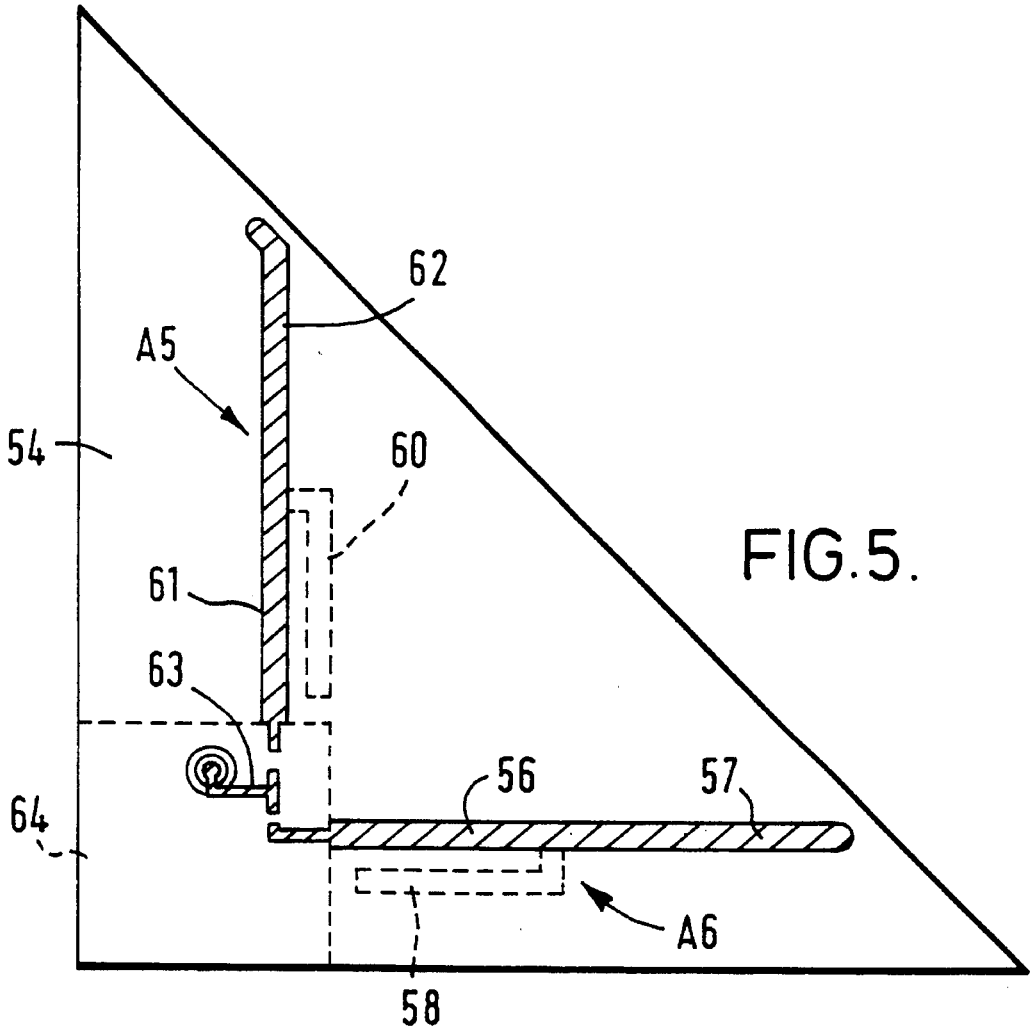
FIG. 5 illustrates a polarization diversity unit.

In FIG. 5, two antenna systems according to the invention are shown on a triangular PCB 54. The two sets of strips 56, 57, 61 and 62, on the upper surface of the PCB as viewed (and shown shaded) are arranged orthogonally; on the lower surface, and, therefore, indicated in dashed outline, are the respective folded strip arrangements 58 and 60, and a conductive connection area 64, here shown as a square. The respective antenna systems are indicated as A5 and A6. The connections between the generator 18 and the systems A5, A6 pass through the conductive connection area 64 and feed connection 63 in this arrangement.

It has been found that any two antenna systems according to the invention, if collocated and arranged orthogonally, retain 20 dB isolation between them. This low cross polarization allows the arrangement of FIG. 5 to be used as a polarization diversity antenna unit, i.e. a unit in which one antenna system may be selected when it gives the stronger signal.

Figure 6:
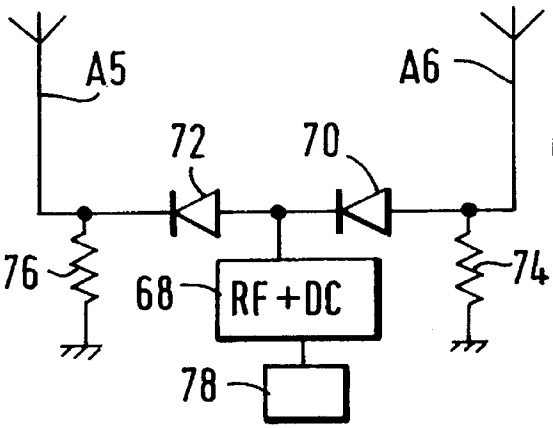
FIG. 6 illustrates the associated switching circuit.

A selection circuit is shown in FIG. 6, with the antenna systems A5 and A6 shown schematically. The feed ends of the antenna systems are connected through a series arrangement of two diodes at 70, 72 and there is an RF generator and DC supply 68 connected between the diodes. The RF supply line to each antenna is provided with a respective current sink resistor 74, 76.

The RF and DC unit 68 is connected to signal transceiver means 78. Suppose the DC current supply is positive and passes to antenna A5 through diode 72; as the signal received from this antenna system fades, the current is switched to negative, so that the other antenna system A6 is brought into operation.

Typically the resistors 74, 76 are each one Kilo Ohm, and the switching diodes 70, 72 are low cost PIN diodes with very low leads inductance. The diodes 70, 72 are located in the gaps between strips 57, 62 and the feed connection 63, respectively, shown in FIG. 5.

The 20 dB isolation between the antenna systems is roughly equal to the depth of the Rayleigh fading in an indoor radio channel. The arrangement of FIGS. 5 and 6 may be applied to permit switching from one antenna to the other to counteract this. The FIG. 5 arrangement may be provided in an adapter for use in an indoor radio channel to allow the connection of personal computers.

Figure 7:
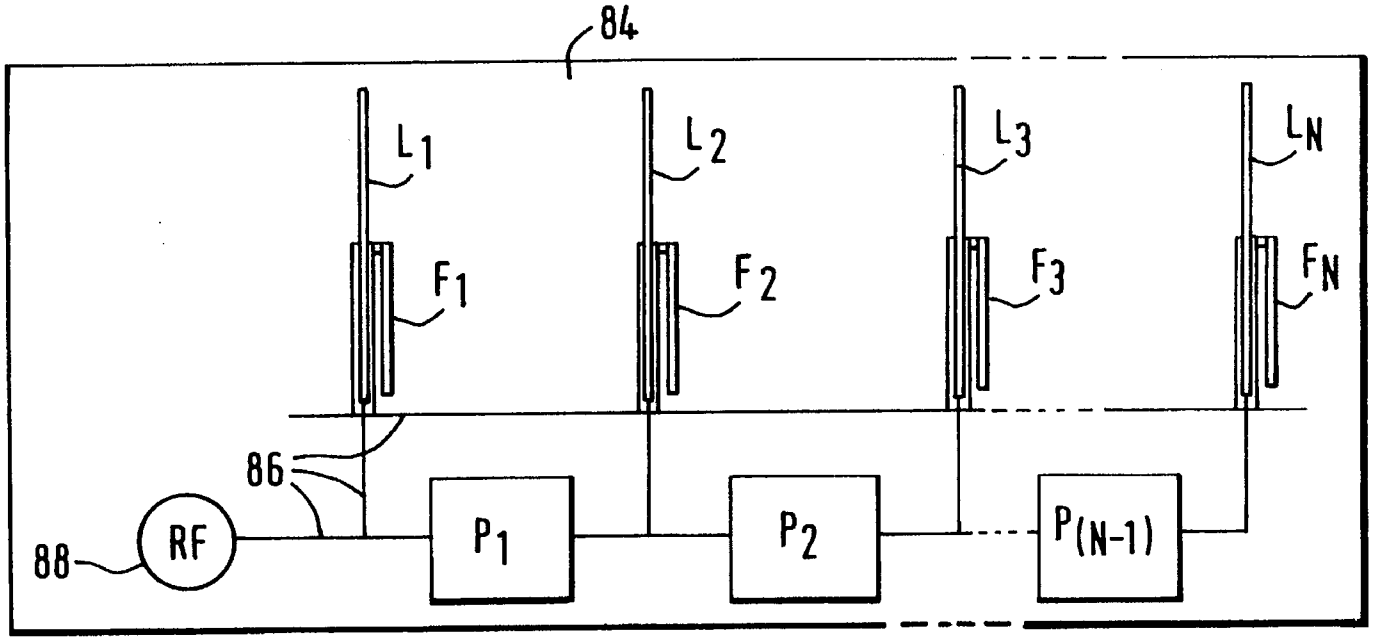
FIG. 7 illustrates an antenna array based on antenna systems according to the invention.

FIG. 7 illustrates an antenna array. The array is provided on a double sided PCB 84 and has N antenna systems, $A_1$, $A_2$, $A_3$ . . . $A_N$ each comprising a linear half wavelength strip $L_1$, $L_2$, $L_3$ . . . $L_N$ on one side of the PCB and shown blocked in, and a folded half wavelength strip $F_1$, $F_2$, $F_3$ . . . $F_N$ on the other side of the PCB. The feed ends of the antennae are interconnected by conventional microstrip lines 86. A phase shifter $P_1$, $P_2$, $P_{(N-1)}$ is connected between each adjacent pair of systems; the first system is connected directly to a RF generator 88, and subsequent systems are supplied through the phase shifters P in series. The arrangement is such that there is a phase delay $\phi$ between each adjacent pair of antennae systems, the phase delay increasing along the array, and each antenna system has almost purely linear polarization. The array can therefore be steered. It will be clear that the higher the number N of systems, the higher the directivity and gain of the antenna array. The microstrip lines 86 give very easy access to the individual antenna systems.

What is claimed is:

1. An antenna system having a first end fed dipole antenna system ($A_5$) for a radio frequency generator having an operating wavelength (L), comprising:

on one side of an insulating sheet (16) a first and a second quarter wavelength (L/4) conductive strip (12, 14) in end-to-end connection;

on the opposite side of the insulating sheet (16) a third quarter wavelength (L/4) conductive strip (22), overlying the first conductive strip (12), and a fourth conductive strip (24) of quarter wavelength (L/4) total length and having a longer arm spaced from and parallel to the third strip (22) and a shorter arm connected to the third strip;

and means to connect said radio frequency generator (18) between the end of the third strip (22) remote from the connection to the fourth strip (24), and the corresponding end of the first strip (12), whereby the second and fourth strips (14, 24) form a linear dipole antenna.

2. An antenna system according to claim 1, characterized in that an unbalanced feed means (18) is connected across said first and second conductive strips (12, 22).

3. An antenna system according to claim 1, characterized by further comprising a second end fed dipole antenna system (A6) arranged orthogonally to the first end fed dipole antenna system (A5).

4. An antenna system according to claim 3, characterized by further comprising switching means (68, 70, 72, 78) to switch between the antenna systems (A5, A6) in accordance with the strength of the signals received.

5. An antenna system according to claim 1, characterized by comprising a further plurality of identical antennae systems all the dipoles being arranged to be parallel, and there being further provided a phase shift means between each pair of systems whereby a steerable antenna array is provided.

6. An antenna system according to claim 1, characterized in that it is connected to a hand held wireless terminal (30).

* * * * *